United States Patent [19]

Pinyan

[11] Patent Number: 4,971,573

[45] Date of Patent: Nov. 20, 1990

[54] ELECTRICAL CONNECTION DEVICE PROVIDING INTEGRAL STRAIN RELIEF

[75] Inventor: James A. Pinyan, Apex, N.C.

[73] Assignee: Raychem Corporation, Menlo Park, Calif.

[21] Appl. No.: 246,399

[22] Filed: Sep. 19, 1988

[51] Int. Cl.[5] ..... H01R 4/24

[52] U.S. Cl. ..... 439/412; 439/431; 439/433

[58] Field of Search ..... 439/727, 728, 729, 800, 439/801, 276, 519, 520, 395–419, 709, 711, 712, 713, 431, 433

[56] References Cited

U.S. PATENT DOCUMENTS

| | | | |
|---|---|---|---|
| 634,766 | 10/1899 | Roche . | |
| 1,924,334 | 8/1931 | Tauber | 173/259 |
| 2,078,825 | 4/1937 | Wisner | 439/412 |
| 2,434,475 | 1/1948 | Sullivan | 173/259 |
| 2,700,142 | 1/1955 | Benander | 339/99 |
| 2,911,615 | 11/1959 | Popejoy et al. | 33/198 |
| 3,052,866 | 9/1962 | Koch | 439/727 |
| 3,129,048 | 4/1964 | Broch | 339/97 |
| 3,163,482 | 12/1964 | Hubbell et al. | 439/412 |
| 3,588,787 | 6/1971 | Kindell | 339/95 |
| 4,146,289 | 3/1979 | Kirrish | 339/95 |
| 4,153,323 | 5/1979 | Wildi et al. | 339/95 |
| 4,446,332 | 5/1984 | Dauser, Jr. | 174/87 |
| 4,652,071 | 3/1987 | DeBortoli et al. | 339/99 R |
| 4,734,061 | 3/1988 | Randall, Jr. et al. | 439/801 |
| 4,846,721 | 7/1989 | DeBruycker et al. | 439/411 |

FOREIGN PATENT DOCUMENTS

| | | | |
|---|---|---|---|
| 0246855 | 11/1987 | European Pat. Off. . | |
| 0298713 | 1/1989 | European Pat. Off. . | |
| 1000882 | 2/1952 | France | 439/411 |
| 460106 | 9/1968 | Switzerland . | |
| 716777 | 10/1954 | United Kingdom . | |
| 2083293 | 3/1982 | United Kingdom | 439/801 |

*Primary Examiner*—David L. Pirlot

*Attorney, Agent, or Firm*—A. Stephen Zavell; Herbert G. Burkard

[57] ABSTRACT

The invention provides for an electrical connection device wherein the portion of the device making the electrical contact is part of but spaced apart from the point of mechanical retention of the wire to which an electrical contact is made. More particularly, the invention provides a terminal block wherein the major portion of mechanical retention is at a point different from that point at which the electrical contact is made.

14 Claims, 4 Drawing Sheets

ELECTRICAL CONNECTION DEVICE PROVIDING INTEGRAL STRAIN RELIEF

FIELD OF THE INVENTION

This invention relates to an electrical connection device providing strain relief integrally but apart from the point of electrical contact. More specifically, this invention relates to an electrical connector preferably in a terminal block. In particular, this invention relates to a rotary or push electrical connector for terminal blocks described in U.S. applications Ser. Nos. 07/070,475 filed July 7, 1987, entitled "Terminal Block", now abandoned; 07/102,072 filed Sept. 29, 1987, entitled "Terminal Block Adapter", now abandoned; 07/130,347 filed Dec. 8, 1987, entitled "Terminal Block Adapter", now abandoned; 07/157,442 filed Feb. 17, 1988, entitled "Telecommunications Terminal Block", now U.S. Pat. No. 4,846,721 07/164,261 filed Mar. 4, 1988, entitled "Telecommunications Terminal Block or Adapter", now abandoned; 07/164,301 filed Mar. 4, 1988, entitled "Telecommunications Terminal Block and Caps Therefor"; and 07/231,755 filed Aug. 12, 1988, entitled "Telecommunications Terminal Block or Adapter." Each of the preceding applications is completely incorporated herein by reference for all purposes.

BACKGROUND OF THE INVENTION

Various configurations of terminal blocks are used in the telecommunications industries or other industries which require many wire connections at a terminal block, fuse box, and the like in an apparatus. For example, the drop wire in the telecommunication industry will be attached to a terminal block such that the major cable will provide individual wires for the wires going to individual homes. The fuse panel in homes or in machines often require many wire electrical connections at a given point. When the electrical and mechanical connection is made at the same point on the wire to provide both the electrical connection as well as mechanically holding the wire in place, the pivot point of the mechanical connection may break the wire or the wire may undergo a cold working at the attachment point which over time results in a broken electrical connection. High vibration environments accelerate this situation and shorten the connection's lifetime.

The Applications enumerated above teach innovative terminal blocks and methods for forming electrical connections without the need for wire stripping and bending around a terminal post. This provides for a faster and stronger electrical connection. Forming the electrical connection without stripping the wire speeds the installation process as well as provides additional protection for the wire for strain relief purposes. This type of electrical connection, although ideally suited for terminal blocks, finds applications in any device where it desirable to provide an electrical connection while maintaining the vast majority of the insulation on the wire apart from the point of the electrical connection. Although this connection provides greater strain relief than a stripped wire, a contact configuration with greater strain relief would further increase the connection lifetime and be highly desirable.

It is thus an object of this invention to provide an electrical connection device which can electrically connect a wire to a suitable terminal post or any electrical connection where enhanced strain relief benefits the reliability of the connection. It is also an object of this invention to form an electrical connection without the need for wire stripping. Additional objects of the invention will be apparent from the following description.

SUMMARY OF THE INVENTION

This invention provides an electrical connection device, especially suitable in terminal block applications, which accomplishes the previously recited objects and obtains the desirable features recited previously and also provides additional benefits readily apparent to the skilled artisan from the following more detailed description.

More specifically, the invention provides a device which decouples the electrical connection portion of the device from that portion which provides mechanical gripping of the wire but retains these functions in an integral unit. Thus, the portion of the wire subject to the need for strain relief is held in place and surrounded by the buffering insulation. This is accomplished by shaping the electrical connector and base support to securely hold the wire isolated from but in the same proximity as the electrical connection being made by the cutting edge of the electrical connector.

DETAILED DESCRIPTION OF THE INVENTION

The invention will be more particularly described with reference to the Figures.

Figure 1:
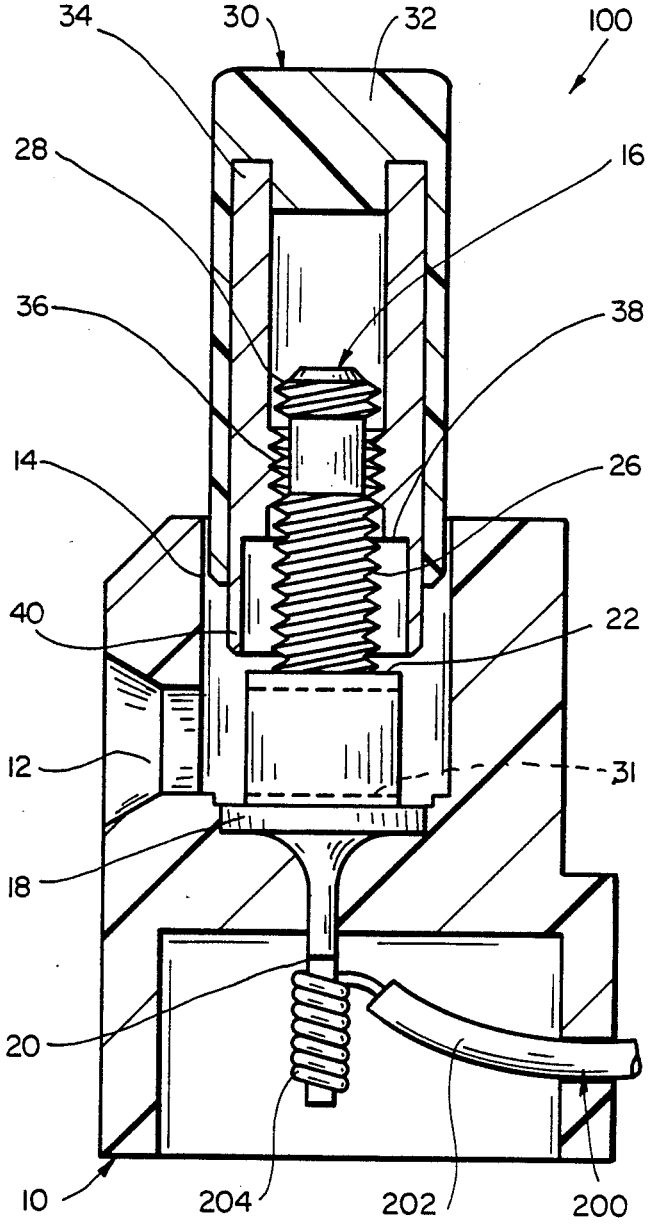
FIG. 1 is a cross-sectional illustration of a single sided terminal block for small gauge wire which incorporates the concepts of the invention.

FIG. 1 represents a cross-sectional view of a terminal block 100. The terminal block 100 comprises a base member 10 and a cap 30. Base member 10 includes a first aperture 12 capable of receiving the wire to which electrical contact will be made and a second aperture 14 in communication with the aperture 12 to receive the cap 30.

Figure 2:
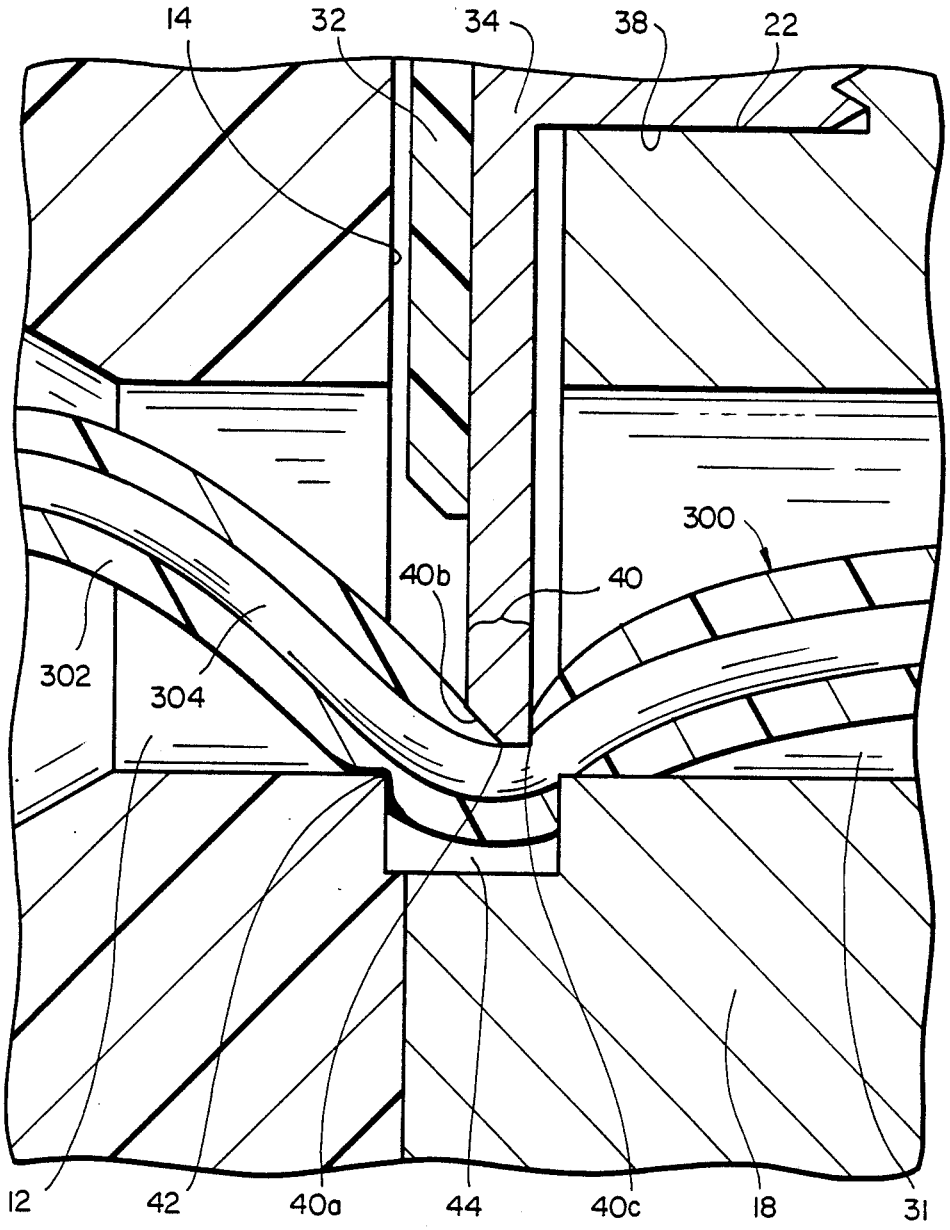
FIG. 2 is an exploded view of the cap and block portion of the terminal block depicting the formation of an electrical contact with the wire and the mechanical gripping of the wire to provide strain relief.

The base member 10 further includes a conductive binding post 16 fixed in the base member 10. The conductive binding post 16 has a broader base region 18 and a portion 20 for connecting to a conductive core 204 of a wire 200. The wire 200 has insulation 202 and the conductive inner core 204. The conductive binding post 16 further includes a binding post shoulder 22 broader than the threaded binding post sections 26 and 28. Between the binding post shoulder 22 and above the broader base region 18 is binding post aperture 31 for receiving a drop wire 300 (FIG. 2). A drop wire 300 is inserted through the first aperture 12 and pushed through the aperture 31 in the binding post 16 until it abuts the portion of the base member 10 opposite to the aperture 12. If the binding post aperture 31 includes a central divider and the base member 10 includes an aperture opposite the first aperture 12, FIG. 5, then the cap 30 can connect two wires, pushed through the apertures to meet at the divider, together. In a like fashion, a plurality of apertures in the base member 10 and the binding post 16 permit a plurality of wires to be connected.

The cap 30 includes an insulating outer part 32 and a conductive inner part 34. The conductive inner part 34 contains a threaded portion 36 to engage the threaded binding post sections 26 and 28. The two threaded binding post sections 26 and 28 permit the cap 30 to be screwed down through and unscrewed from the aperture 14 from the aperture 12 region without falling out of the terminal block 100. Only if the cap 30 is further twisted to engage the threaded section 28 can it be completely removed. This feature avoids inadvertent loss of the caps 30. The cap 30 also includes a mechanical contact/cutting edge 40 capable of cutting through the insulation of the wire inserted through the aperture 12. The mechanical contact/cutting edge 40, the binding post shoulder 22 and the cap shoulder 38 are proportioned so that when the cap 30 is completely tightened on the binding post 16, there is sufficient space between cutting edge **40*a*/40*c* and the broader base region 18 so as to not sever the smallest size of wire to be utilized with the connector 100**.

The electrical connection mechanical strain relief feature is more specifically illustrated in FIG. 2. FIG. 2 is a blown up cross-sectional view of the portion of the terminal block 100 with cap 30 in its tightened position on a small drop wire. When tightened down onto a wire 300, the cutting edge portion **40*a* cuts through and displaces the insulation 302 to make electrical contact with the conductive core 304. A blunt chamfer 40*b* pinches the wire 300 for a tight mechanical hold with the base member 10 at the base member edge 42. The blunt chamfer 40*b* can have any shape, such as convex, concave, semi-circular, and the like provided the surface pressures and deforms the wire 300 without completely severing the insulation 302. As illustrated, sufficient space is allowed between 40*a* and the base member 18 when the cap 30 is fully tightened so that a positive electrical contact is made without completely severing the conductor core 304 of the wire 300. Optionally, edge 42** can also be chamfered or filled with the base member material.

An additional optional feature is also illustrated in FIG. 2. The positioning of the broadened base 18 is recessed, as illustrated by region 42 to be slightly below the aperture 12 and the binding post opening 31. When the cap 30 is tightened, the wire 300 is crimped down slightly to ensure an additional and more positive electrical contact at the edge **40*c* and the wire 302**.

Figure 3:
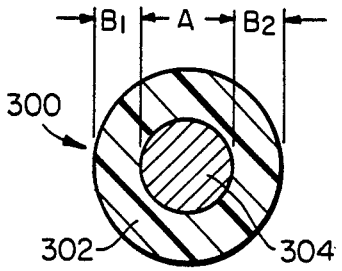
FIG. 3 is a cross-sectional illustrative view of a piece of wire.

The gap between the cutting edge **40*a* and the broadened base portion 18 is preferable at least equal to or less than A plus $B_1$, or $B_2$ but sufficiently large to preclude cutting the conductor core 304 or more preferably as illustrated in FIG. 3. Of course, allowance must be made for the compression of the insulation 302 under pressure. This ensures an electrical contact to the conductive wire core 304. This distance is provided by proportioning the binding post shoulder 22 to meet the cap shoulder 38 with a length for the mechanical contact/cutting edge 40 at the cutting edge 40*a* to base 18 to be less than or equal to A plus $B_1$, or $B_2$ for the smallest size of wire utilized with the electrical contact device 100**. Larger sizes of all copper wire can be cut up to about fifty percent of the diameter A and the strain relief feature ensures that any cold working of the wire is away from the electrical contact portion.

The mechanical retention occurs between the blunt edge **40*b* and the base edge section 42. Preferably, the base 10 but especially the base edge 42 material yields before the conductor wire 304. This prevents the edge 42 from cracking or cutting the wire 304 and thus creating a weak point. Thus the electrical contact function is decoupled from the mechanical contact function. Of course, the pressure of edge 40*a* on the wire 304 and broadened base 18 also provides a means for retaining the wire. However, the additional decoupled contact point through the wire 304 and insulation 302 of $B_1$, plus $B_2$ provides mechanical retention less subject to cold working, i.e., this provides strain relief apart from the formation of the electrical contact. Optionally, the edge 42 can be shaped, i.e., chamfered to be parallel with the edge 40*b*. When tightened, the distance between 40*b* and 42 must be less than the diameter of the wire 304 plus insulation 302, i.e., less than $A+B_1+B_2$. The exact amount is a function the gripping power required for a particular application. In telecommunication applications, the contact strain relief feature is most desirable for small wires, i.e., 19, 22 and/or 24** AWG, because larger wires, especially those with steel core and copper claddings, provide sufficient mechanical strength to be less subject to premature failure from fibration or cold working.

More specifically, strain relief is provided between the edge **40*b* which pinches the insulation 302 to the shoulder 42. This provides the mechanical retention for the wire 300 in terminal block 100 apart from electrical contact and retention between 40*a*/40*c* and 18. Thus, the mechancial retention means between 42 and 40*b* are isolated from the primary electrical connection means 40*a*, 40*c* and 18**. This decoupled but integral mechanical retention and the adjacent electrical contact provides strain relief for any electrical wire subject to vibration or repeated twisting and pulling without the need for additional wire restrainers. Thus, the benefits of the terminal block designs described and illustrated in the previously recited applications are maintained and enhanced with this additional strain relief feature.

Figure 4:
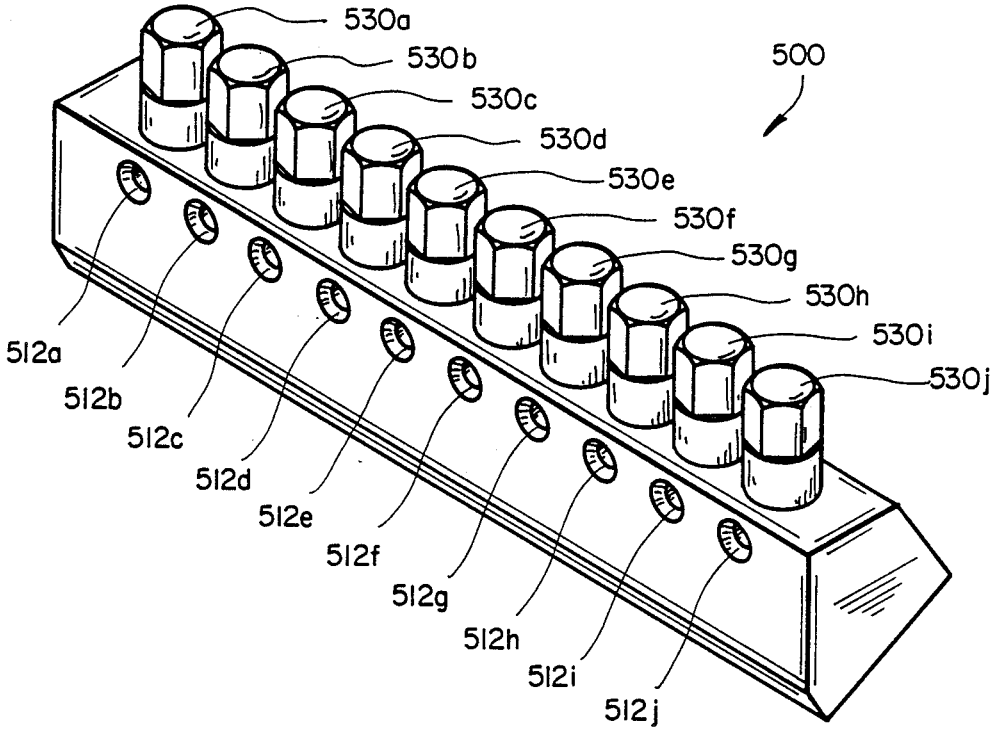
FIG. 4 illustrates a terminal block for a plurality of wires.
Figure 5:
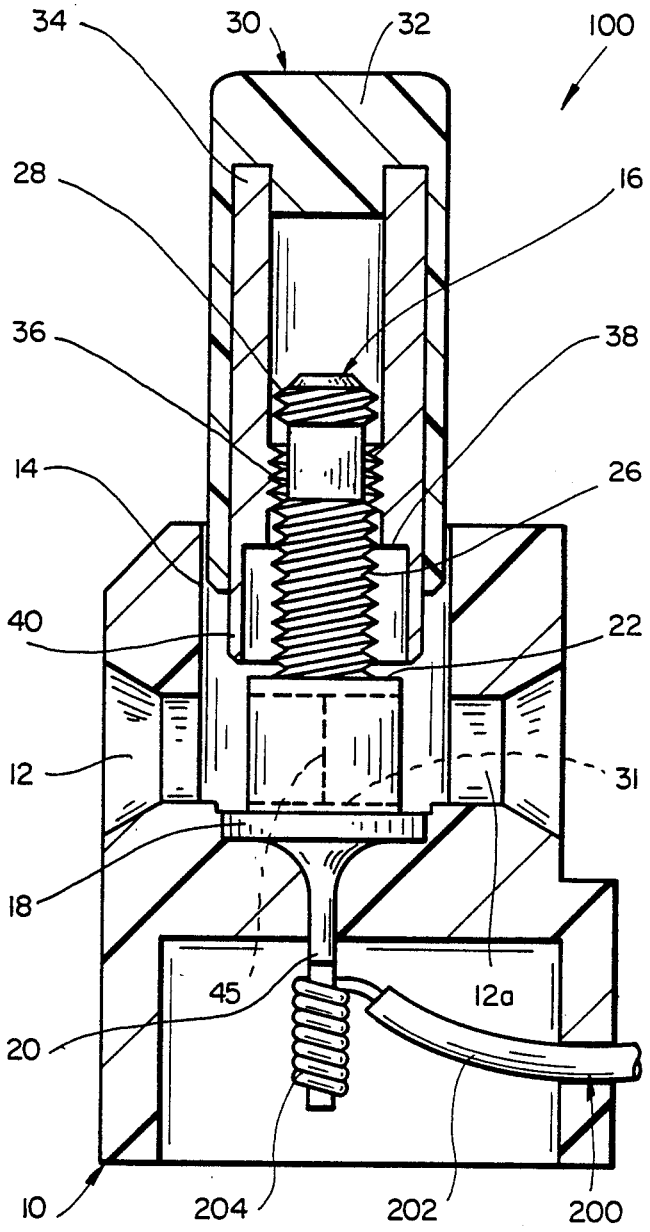
FIG. 5 illustrates an embodiment for multiple wires.

FIG. 4 illustrates a terminal block 500 having a base 510 (10 in FIG. 1) with a plurality of apertures 512 (12 in FIG. 1) and a plurality of caps 530 (30 in FIG. 1) fitted into a plurality of second apertures not visible. Of course the other internal aspects of the invention, not illustrated, are similar to the illustrations in FIGS. 1 and 2. FIG. 5 illustrates the embodiment where a third aperture **12*a* is opposite the first aperture 12 and the conductive binding post 16 contains a divider 45 for the abutment of a wire inserted through the third aperture 12*a*. The numbering of the similar items in FIG. 5 to FIG. 1 is retained to simplify the understanding. The addition of additional apertures, not illustrated, permit the coupling of any desired number of wires. Furthermore, adjusting the height of aperture base position of the aperture 12 as illustrated by edge 42 in FIG. 2 and the base member 18, permits coupling wires of different sizes. Additionally, any voids in the terminal block can be sealed with a sealing material such as a gel to provide environmental sealing. A suitable gel has a cone penetration value as measured according to ASTM D127-68 at 21° C. of about 100–350 ($10^{-1}$ mm) and an ultimate elongation as measured by ASTM D638-80 at 21° C. of at least about 200%. Greater details are specified in the previously recited applications. Of course, an open or closed vented area within the base member 10** is preferred when a gel is used in conjunction with the terminal block.

Although the invention has been described with reference to a terminal block for the telecommunications industies, it would be readily apparent to the ordinary skilled artisan that this mechanical/electrical contact and strain relief is suitable for any type of electrical connection where strain relief of the wire is necessary to avoid cold working and premature failure. Modifications which would be ovbious to the ordinary skilled artisan are contemplated to be within the scope of the invention for example to cap 30 could have male threads protruding from within the cutting edge 40 and screw into a female base. Furthermore, the cap and post 16 can be configured to engage in a racheting manner or by a pressure fit rather than by screwing together. Clearly the cutting edge strain relief can be slotted rather than circumferential because only the leading edge provides the strain relief feature in conjunction with the electrical contact unless multiple wires are connected through multiple apertures. Thus the invention in its broadest concept is the decoupling but integral connection of the electrical connection point and the mechanical attachment point to obtain a substantially single functioning unit. Any means suitable for accomplishing this feature is contemplated to be within the scope of the invention.

I claim:

1. Apparatus for forming an electrical connection to a wire comprising:

a base member;

a first aperture in the base member for receiving an electrical wire;

a second aperture spaced apart from the first aperture for receiving a cap, the second aperture intersecting the first aperture;

an electrically conductive binding post fixed in the base member and protruding into said second aperture said electrically conductive binding post contains an aperture in substantial alignment with the first aperture for the insertion of a wire therethrough;

a cap substantially filling the second aperture and capable of engaging the binding post, the cap including a central conductive portion and an outer nonconductive portion surrounding the central conductive portion, the central conductive portion including conductive means for cutting wire insulation and means for mechanically cooperating with the base member immediately adjacent a region forming an electrical contact with a wire and the aperture in the electrically conductive binding post to retain the wire within the apparatus and the binding post while forming an electrical contact thereto; and cooperative restraining means between the binding post, the aperture in the binding post, and the cap to restrain the conductive cutting means from completely severing a wire inserted into the first aperture.

2. The apparatus according to claim 1 wherein the cooperative restraining means is a shoulder on the binding post capable of engaging a shoulder on the conductive portion of the cap prior to the conductive means for cutting wire insulation touches a conductive base region of the conductive binding post.

3. The apparatus according to claim 2 wherein the conductive means for cutting wire insulation is a cutting edge having a face parallel to a conductive base member portion of the conductive binding post and an angled shoulder capable of fixing a wire without cutting through the wire insulation between the base member and the angled shoulder.

4. The apparatus according to claim 3 further comprising a cavity within the base member, the cavity capable of receiving a crimped portion of a wire when the cap is engaged to pressure the wire inserted into the binding post.

5. The apparatus according to claim 4 wherein the cooperative retaining means are selected from the group consisting of threads on the binding post and female threads on the cap, female threads within the base member and male threads on the cap protruding from within the conductive means for cutting wire insulation, and notching ribs on the binding post and the cap.

6. The apparatus according to claim 4 including a plurality of spaced apart binding posts fixed within the base member, each binding post oriented within a plurality of second apertures and each second aperture in communication with its own first aperture for receiving a wire and a cap for each binding post.

7. The aperture according to claim 4 wherein a base member shoulder which pinches the wire to a blunt portion of the electrically conductive cutting edge forms a point mechanical contact.

8. The apparatus according to claim 7 wherein in the base member has a second or a plurality of apertures spread apart from the first aperture but in substantial alignment therewith and the binding post includes a divider within the electrically conductive binding post aperture for each aperture in the base member.

9. The apparatus according to claim 8 wherein the binding post contains a single aperture within the binding post for all the base member apertures.

10. The apparatus according to claim 9 wherein a base member shoulder pinches the wire to a blunt portion of the electrically conductive cutting edge over a region greater than a point mechanical contact.

11. The apparatus according to claim 10 wherein the base member shoulder and the blunt portion of the electrically conductive cutting edge are chamfered to be substantially parallel.

12. The apparatus according to claim 11 further including an environmental sealing material within the base member apertures.

13. The apparatus according to claim 12 wherein the base member contains a third aperture in communication with the first and second apertures to receive the sealing material displaced from the first and second apertures upon the insertion of a wire into the wire aperture and/or the engagement of the cap on the binding post.

14. The apparatus according to claim 13 wherein the third aperture for the displaced sealing material internally communicates with the first or second apertures.

* * * * *